United States Patent [19]

Simonelli

[11] 4,281,422

[45] Aug. 4, 1981

[54] SWIMMING POOL WINTERIZING DISCONNECT UNIT

[76] Inventor: Louis R. Simonelli, 40 Diaz St., Stamford, Conn. 06902

[21] Appl. No.: 80,156

[22] Filed: Sep. 28, 1979

[51] Int. Cl.[3] ..... E04H 3/18

[52] U.S. Cl. ..... 4/496; 4/506; 4/507; 138/89.1; 138/90; 137/232

[58] Field of Search ..... 4/488, 492, 496, 506, 4/507; 138/89.1, 90; 137/232

[56] References Cited

U.S. PATENT DOCUMENTS

| | | | |
|---|---|---|---|
| 1,331,347 | 2/1920 | McNamara | 138/89.1 |
| 3,577,571 | 5/1971 | Bellinson | 4/492 |
| 4,135,549 | 1/1979 | Baker | 4/488 |
| 4,170,044 | 10/1979 | Steimie | 4/488 |

*Primary Examiner*—Henry K. Artis

[57] ABSTRACT

A disconnect unit for the isolation of the aqueous contents of a swimming pool from pump lines running into said pool which permits contained water to be blown clear of said pump lines without need to remove any substantial quantities of water from the pool. The unit comprises a pool inlet fitting having a check valve permanently mounted therein and adapted to have inserted within the check valve at its distal end a compressed air nipple and at its proximal end frictionally and permanently embedded into the wall a blocking membrane for the inlet fitting member. The device functions by the first insertion of the compressed air nipple 1 into the check valve 2 and the locking of the shoulders of the two members together. The air line to the pump is then blown clear of water. Once the line is free of air, nipple 1 is withdrawn by lateral compressive pressure on the check valve 2 which locks the check valve and blocks the pool line to further passage of water flowing in from the pool and disconnects the air compressor at the same time.

1 Claim, 2 Drawing Figures

SWIMMING POOL WINTERIZING DISCONNECT UNIT

BACKGROUND OF THE INVENTION

At the present time swimming pools are winterized by removal of large quantities of water from the pool sufficient to expose the inlet opening of the water leading from the pumps into the upper lateral wall of the pool. Once the inlet is exposed the compressor is attached at either the filter end or the pool inlets, turned on and run with air blown through the lines until all of the water in the line is expelled back either into the pool or expelled from the filter and the lines from the recirculative pump to the pool are clear of water. The pool openings are then capped with a rubber expansion plug and the pool refilled and covered with a vinyl pool cover for the winter.

The time and expense of this mode of operation is of course obvious. In addition to the loss of hundreds and perhaps thousands of gallons of water in the process of winterizing the pool, the labor factor involved in removing and refilling all this water is not inconsiderable. The use of the disconnect unit cuts the time and labor of winterizing the pool in half each year and hence drastically cuts the cost to the consumer of maintaining a swimming pool. The use of the disconnect plug guarantees to the pool owner as well as the service and maintenance crew that all pool lines are water free at the time that they finish their processing of the pool in preparation for the freezing temperature of winter.

The known and current method of winterizing swimming pools is with a three inch pump which is used to pump out several thousand gallons of water and drop the water level of the pool anywhere from 2 to 3 feet.

When this water level is depressed this exposes the water inlet and the skimmer device which is built into one concrete wall of the pool and connected by pipe to the filter system in the pool house as well as the main suction drain in the bottom of the pool. Under current winterizing, one either attaches an air compressor line at the skimmer cavity and blows water free of the lines from the pool skimmer to the filter station which is usually at a distance of from 20 to 100 feet away or in a similar manner clears the line from the skimmer to the main drain at the center of the pool which is usually a distance of about 15 to 20 feet away. With either operation it is required to keep an air gap of at least 2 feet in either direction to prevent freeze up. The creation of the air barrier in the lines at present is difficult because it involves simultaneously removing the air compressor nozzle and inserting the rubber plug before the water rushes back into the line.

In addition to the foregoing problems with pool winterizing the maintainence crew bringing in pumps and discharge hoses over the pool owner's property frequently involves marking walkways and pool areas with rubber hose smudges. Frequently the release of the water causes flooding of the adjacent land in the pool site at winterizing times.

It would obviously be of advantage to the pool owner to avoid these problems and have available a simple inexpensive means of disconnecting and cleaning the pool lines of water to result in a safe and simple reconnect or spring opening as well as a quick and efficient pool shut down. The present invention in pool disconnect plug device is designed to afford these advantages.

OBJECTS OF THE INVENTION

It is a primary object of this invention to provide a disconnect plug means and method which permits a swimming pool to be winterized by removal of the water from the inlet and outlet lines without removal of water from the pool.

It is a second object to disclose a disconnect plug unit which can be permanently installed in the system and which will not pop out of the fitting during the winter.

It is a further object to disclose a disconnect plug which contains a pressure activated valve which remains closed until an air hose outlet is inserted therein and which upon such insertion becomes open to passage of compressed air or water.

It is a specific object to disclose a plug and valve means which permits the introduction of compressed air into the plug by compressively opening the same internally and subsequently closing the valve by exertion of internal lateral pressure on the external wall of this plug.

BRIEF DESCRIPTION OF THE INVENTION

In general it is contemplated in accordance with the present invention that an inexpensive and easily insertable disconnect plug device which can be quickly and economically installed will be provided. It is further contemplated that the device will be utilized in conjunction with compressed air equipment which is connected thereto and utilized to pump air under pressure through the device in its inlocked position to force water lodged in the water inlet lines between the pool and the pump out of those lines. Once this water has been forced out of the lines, the air hoses and nipple is disconnected and the new disconnect plug automatically placed into its locked and closed position by removal of the tip of the air hose nipple therefrom.

Thus in accordance with this invention a unique watertight disconnect unit is provided which makes it possible to insert the nipple of an air compressor line therein and open an interior valve to permit entry and passage of compressed air therethrough while withdrawal of the said nipple automatically closes said interior valve and halts immediately flow of either air or water through the disconnect unit or any tubes, conduits or water feed lines connected therewith. Once the disconnect plug and its interior valve has been closed, a means for attachment of a plastic cover over the entire housing of the plug is also provided.

For a more complete understanding of the practical application of this invention, reference is made to the appended drawings in which.

Figure 1:
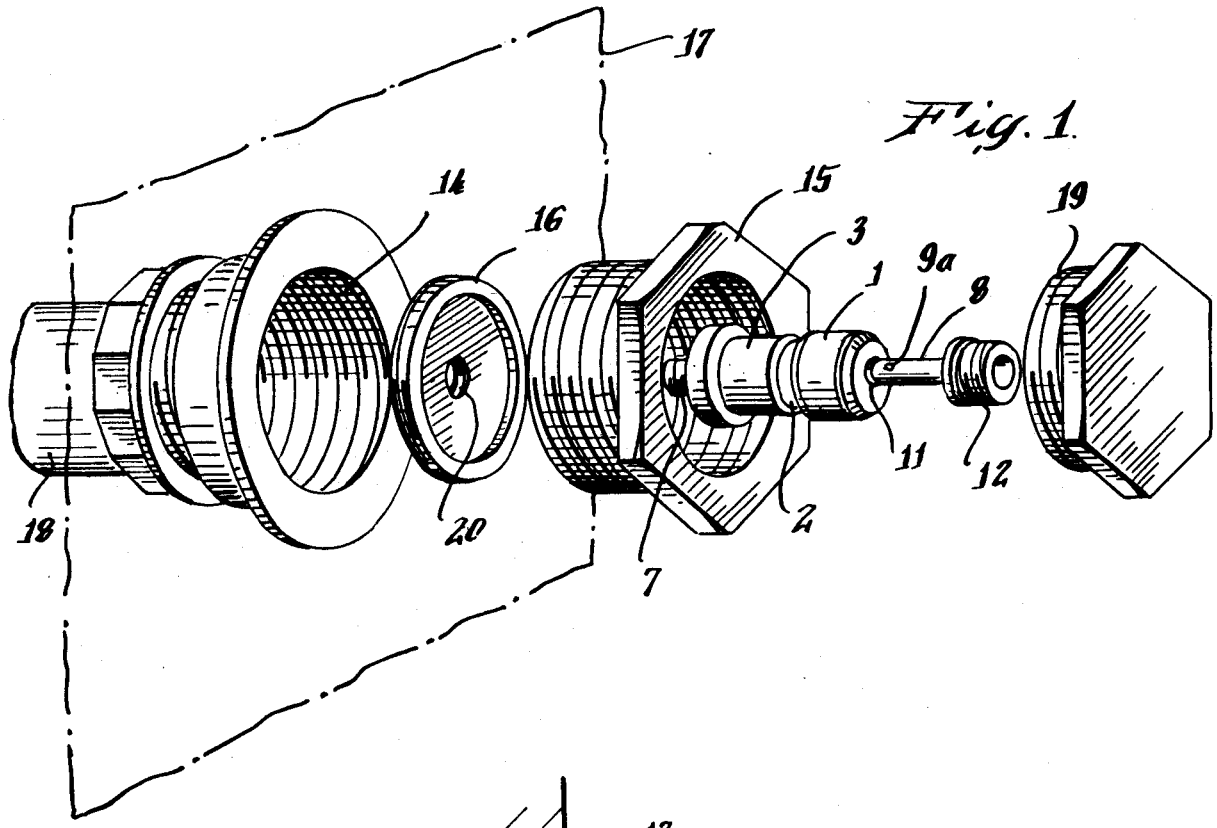
FIG. 1 is an exploded perspective view of a disconnect plug made in accordance with this invention in a closed and locked position.
Figure 2:
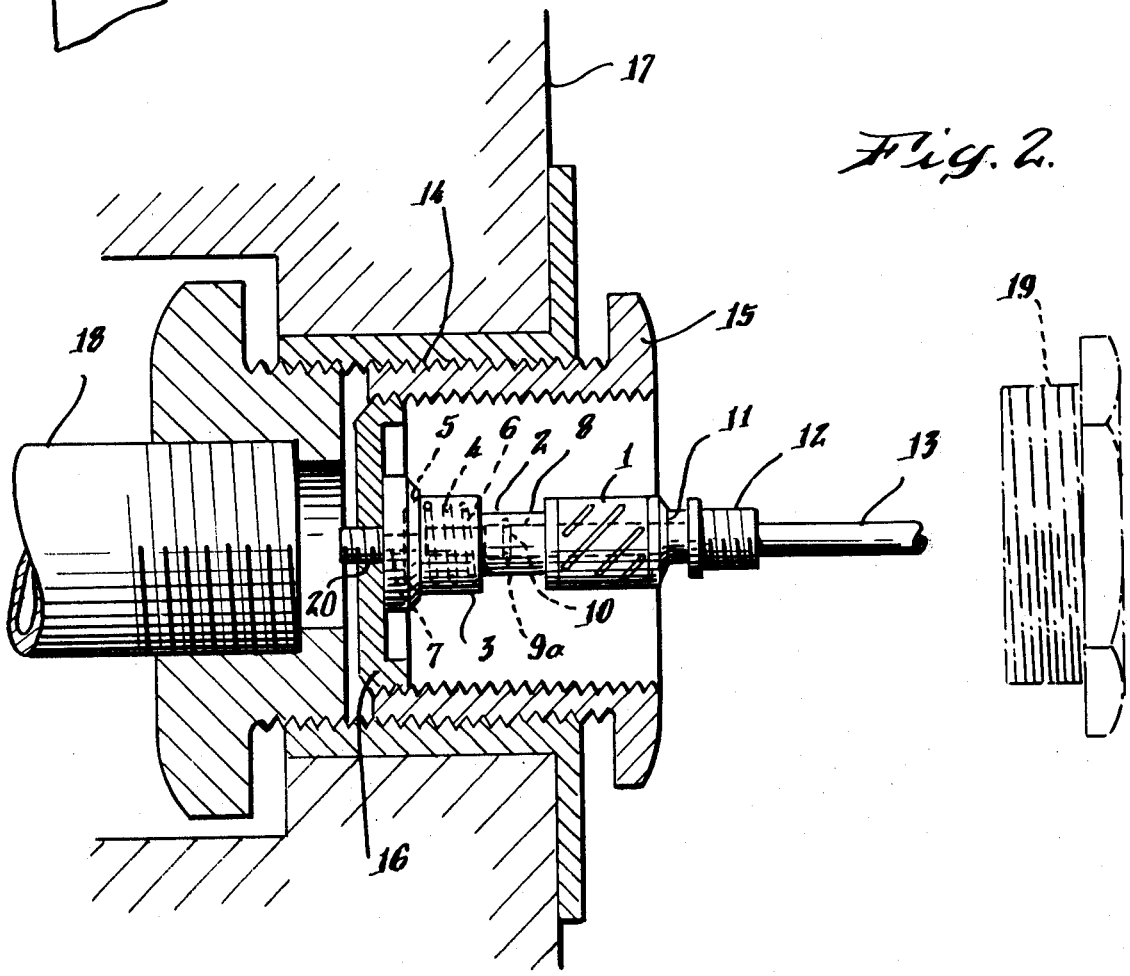
FIG. 2 is a cross sectional view of the device of the invention in its open position with the tip of an air compressor line inserted therein to compress check valve compression spring 3.

Describing the device by reference to FIGS. 1 and 2 of the drawing a movable plug is shown having a check valve release member 1 which is slidable inward or outward by application of hand pressure and abuts on check valve outer housing 3. A check valve inner sleeve 2 is stationary and has in its walls three locking ball bearings 9*a*, 9*b* and 9*c* which pop out to fit into nipple locking groove 10 when air compressor nipple 8 is inserted into check valve inner sleeve 2. The insertion of nipple 8 into inner sleeve 2 causes the tip of the nipple to impinge upon compression spring 4 which when compressed forces valve seat 5 downward and away from valve stem 6 to permit passage of air around stem 6 and through aperture 7 into pool line forcing out water from line 18 by passage of air through central portal 20.

The air compressor nipple 8 is inserted through entrance portal 11 and is connected to a compressed air hose 13 through connector 12. Once the nipple 8 is inserted and the valve opened the locking ball bearings pop out of the wall of sleeve 2 to set in groove 10 and hold valve open until released. The entire plug fits into a female wall receptacle 14 of conventional design and is fixed into position by screw threads on socket plug 15 which acts as an outer housing for the check valve. The socket plug has a solid backing wall 16 and a central portal 20 which feeds air into the female receptacle 14 in the pool wall 17 and hence into the pool water line 18 to force water out of the said line at the pump end.

Once the compressed air so introduced has forced the water from the pool lines, the check valve release member is moved outwardly from the pool wall. This movement outward exerts pressure on connector 12 forcing the nipple 8 to release its compressive pressure on spring 4 and force locking bearings **9*a*, 9*b* and 9*c* out of the locking groove 10 to release the nipple. Once the pressure on spring 4 is relaxed the valve seat 5 returns to impinge on valve stem 6 and closes off the aperture 7 to the pool line to halt further back flow of air or water therethrough. The flow of water into the line is naturally also blocked instantly and the air compressor line once removed closes off the entire system. To finish the job, a plastic cap or cover 19** is placed over the line for the winter.

To reactivate the water feed lines, expel the air in the lines and reactivate the system in the summer a key is inserted over interior socket plug 15 to remove the entire unit from the wall. This causes a flow of water to emit from the water lines 18 into the pool through the opening 14. In the fall the process is reversed by inserting the disconnect unit and starting the entire process over again.

A number of variations in my invention concept will occur to the reader upon review of the foregoing specifications and following claim to my invention. It is my intention to claim all of these as part of my invention.

I claim as my invention:

1. A disconnect unit for the isolation of the aqueous contents of a swimming pool from pump lines running into said pool which comprises:

(a) a pool inlet fitting having a check valve permanently mounted therein adapted to having inserted within the check valve at its distal end a compressed air nipple, (b) said fitting further adapted at its proximal end to be inserted into the terminal end of a pump line or lines which feed the pool with water and, (c) said fitting containing a spring mechanism which when compressed opens the passageway of the valve for the passage of water or air, and when relaxed, closes the passageway for water or air into the passageway and wherein, (d) said fitting is adapted by means of a plurality of ball bearings positioned in the wall of the inner sleeve 2 which pop out to fit into the nipple locking grove 10 to hold the valve open to permit the flow of air or water peripherally about the circumference of the fitting when the compressed air nipple has been inserted and the spring mechanism compressed, and to halt the flow when the nipple has been removed and the interior spring mechanism has been relaxed.

* * * * *